US005405647A

United States Patent [19]

Grubka et al.

[11] Patent Number: 5,405,647

[45] Date of Patent: Apr. 11, 1995

[54] METHOD FOR APPLYING GRANULES TO A MOVING COATED ASPHALT SHEET TO FORM AREAS HAVING SHARP LEADING AND TRAILING EDGES

[75] Inventors: Lawrence J. Grubka, Heath; James S. Belt, Utica, both of Ohio

[73] Assignee: Owens-Corning Fiberglass Technology Inc., Ill.

[21] Appl. No.: 144,386

[22] Filed: Nov. 2, 1993

[51] Int. Cl.[6] ..... B05D 1/12

[52] U.S. Cl. ..... 427/188; 428/143

[58] Field of Search ..... 427/186, 187, 188, 197, 427/199, 204; 428/150, 143

[56] References Cited

U.S. PATENT DOCUMENTS

| | | | |
|---|---|---|---|
| 1,194,890 | 8/1916 | Spiegel | 427/188 |
| 1,214,658 | 2/1917 | Dun Lany | 427/188 |
| 1,264,831 | 4/1918 | McKay | 427/188 |
| 1,394,149 | 10/1921 | Cumfer et al. | 427/188 |
| 1,916,095 | 6/1933 | Cumfer | 427/188 |
| 3,506,111 | 4/1970 | Eppenberger . | |
| 3,586,069 | 6/1971 | Vest et al. . | |
| 3,693,672 | 9/1972 | Hiland . | |
| 3,797,890 | 3/1974 | Walters . | |
| 3,858,628 | 1/1975 | Bendle . | |
| 3,884,401 | 5/1975 | Winkler . | |
| 3,964,793 | 6/1976 | Volpeliere | 302/3 |
| 4,212,331 | 7/1980 | Benatar . | |
| 4,573,504 | 3/1986 | Rosenstrom . | |
| 4,614,213 | 9/1986 | Englin . | |
| 4,688,610 | 7/1987 | Campbell . | |
| 4,735,241 | 4/1988 | Spiess . | |
| 4,949,163 | 7/1990 | Steele | 366/106 |
| 4,955,270 | 9/1990 | Volk, Jr. | 73/861.71 |
| 4,974,646 | 12/1990 | Martin et al. | 141/67 |
| 5,098,557 | 3/1992 | Hirschler et al. | 209/29 |

FOREIGN PATENT DOCUMENTS

| | | |
|---|---|---|
| 107626 | 5/1984 | European Pat. Off. . |
| 125585 | 11/1984 | European Pat. Off. . |
| 224621 | 6/1987 | European Pat. Off. . |
| 2158813 | 11/1985 | United Kingdom . |

OTHER PUBLICATIONS

Pp. 1–7 of Chapter 1, "Fluidization Engineering", Second Edition, 1991, Kunii & Levenspiel.

Pp. 68–74 of Chapter 3, "Fluidization Engineering", Second Edition, 1991, Kunii & Levenspiel.

*Primary Examiner*—Terry J. Owens

*Attorney, Agent, or Firm*—Ted C. Gillespie

[57] ABSTRACT

The method for applying granules to a moving coated asphalt sheet includes selecting blend drop areas on the sheet, the remainder of the sheet comprising background areas, depositing background granule drops on portions of the background areas such that the background granule drops have generally sharp leading edges which define upstream edges of the blend drop areas and have generally fuzzy trailing edges, depositing blend drops on the blend drop areas such that the blend drops have generally sharp leading edges and generally fuzzy trailing edges which overlap the background granule drops, and then depositing background granule drops on remaining portions of the background areas. The generally sharp leading edges of the background granule drops define the trailing edges of the blend drops so that when blend drops which overlap the background granule drops are removed by inverting the sheet, blend drop areas having sharp leading and trailing edges are produced.

12 Claims, 3 Drawing Sheets

METHOD FOR APPLYING GRANULES TO A MOVING COATED ASPHALT SHEET TO FORM AREAS HAVING SHARP LEADING AND TRAILING EDGES

TECHNICAL FIELD

This invention pertains to the handling of continuous strips of asphaltic material, such as asphaltic material suitable for use as roofing membranes and roofing shingles. In one of its more specific aspects, this invention relates to controlling the application of granules to asphaltic strip material.

BACKGROUND OF THE INVENTION

A common method for the manufacture of asphalt shingles is the production of a continuous strip of asphaltic shingle material followed by a shingle cutting operation which cuts the material into individual shingles. In the production of asphaltic strip material, either an organic felt or a glass fiber mat is passed through a coater containing liquid asphalt to form a tacky, coated asphaltic strip. Subsequently, the hot asphaltic strip is passed beneath one or more granule applicators which apply the protective surface granules to portions of the asphaltic strip material. Typically, the granules are dispensed from a hopper at a rate which can be controlled by making manual adjustments on the hopper. In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

To provide a color pattern of pleasing appearance the colored shingles are provided in different colors, usually in the form of a background color and a series of granule deposits of different colors or different shades of the background color. These highlighted series of deposits, referred to as blend drops, are typically made from blenders which comprise a series of granule containers connected to feed rolls. The length and spacing of each mixture on the sheet is dependent on the speed of the feed roll, the relative speed of the sheet and the length of time during which the drop is made.

Not all of the granules applied to the hot, tacky, coated asphaltic strip adhere to the strip, and, typically, the strip material is turned around a slate drum to invert the strip and cause the non-adhered granules to drop off. These non-adhered granules, which are known as backfall granules, are usually collected in a backfall hopper and reused on the shingle.

One of the problems with typical granule application equipment is that the feeder rolls depend on mechanical movement (rotation) to index to the next position to enable another blend drop to fall onto the moving coated asphalt sheet. This requirement for mechanical action has inherent limitations which prevent a precise beginning and ending to the blend drop. Also, once the mechanical action takes place, there is a short time lag as gravity takes effect on the granules. Consequently, there is a limit to the sharpness of the blend drops on the shingle. As shingle manufacturing lines go up in speed the lack of sharpness is accentuated, and the distinction between the blend drop and the background color becomes fuzzy. The lack of sharpness puts a severe limitation on the kinds of designs and color contrasts which can be applied to the shingle.

A recently developed improved method for depositing granules onto the moving coated asphalt sheet uses a pneumatic control to provide a relatively high degree of preciseness in depositing the granules. The newly developed method provides relatively instantaneous control of the flow of granules. The flow of granules is started, stopped and controlled by providing pneumatic pressure changes in a buffer chamber positioned adjacent an accumulation of granules in a granule nozzle. It has been found, however, that although the pneumatically controlled granule blend drop apparatus provides a very sharp leading edge for a blend drop, it produces a fuzzy or less sharp trailing edge for the blend drop. An improved process would provide for blend drops having both a sharp leading edge and a sharp trailing edge.

SUMMARY OF THE INVENTION

There has now been developed a shingle granule deposition method which provides both a sharp leading edge and a sharp trailing edge for blend drops. This method is carried out by depositing background drops immediately upstream from the intended blend drops so that the leading edge of the background drop defines the trailing edge of the blend drop. The subsequently applied blend drop then applies granules in the blend drop area, but the trailing edge of the blend drop is already defined by the background drop. By applying the blend drops with sharp leading edges prior to the background drops, any number of background drops having sharp leading edges and sharp trailing edges can be applied to the shingle.

According to this invention, there is provided a method for applying granules to a moving coated asphalt sheet comprising establishing predetermined blend drop areas on the coated asphalt sheet, depositing background granule drops on the coated asphalt sheet immediately upstream from the predetermined blend drop areas so that the leading edge of the background drop defines the trailing edge of the blend drop, depositing blend drops on the predetermined blend drop areas, and depositing background granules on the remaining portions of the background areas.

DETAILED DESCRIPTION OF THE INVENTION

Figure 1:
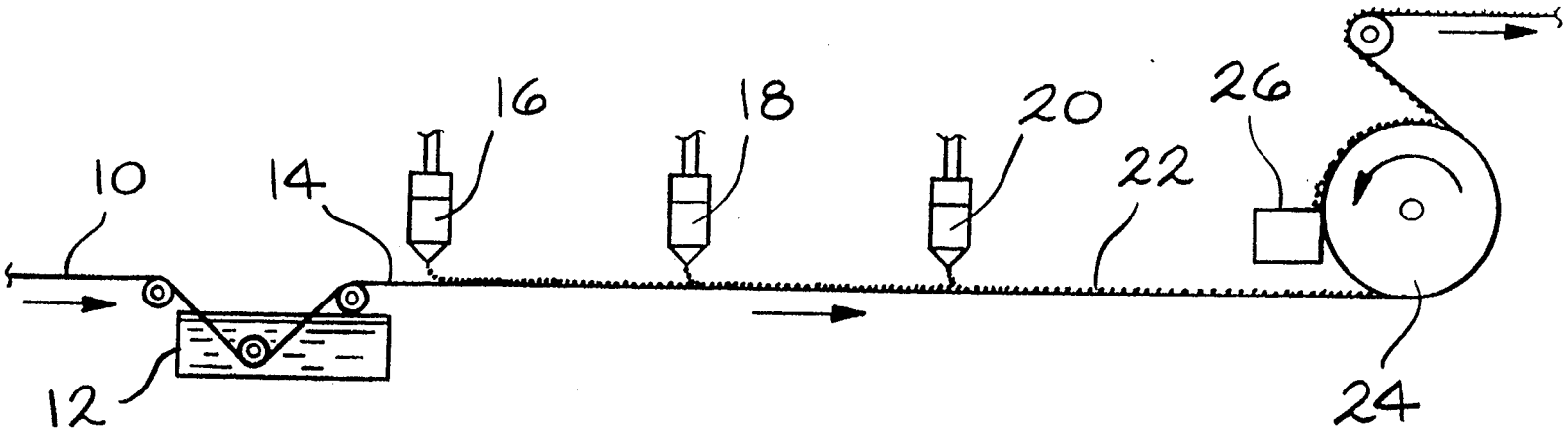
FIG. 1 is a schematic view in elevation of apparatus for dispensing granules according to the principles of the invention.

As shown in FIG. 1, the base shingle mat 10, preferably a fiberglass mat, is passed through asphalt coater 12 to form coated asphalt sheet 14. A series of granule dispensers, 16, 18 and 20 deposit granules onto the coated asphalt sheet to form granule-coated asphalt sheet 22. The granule coated asphalt sheet is turned around a slate drum 24 so that the excess granules can drop off, where they are collected by the backfall hopper 26.

Figure 2:
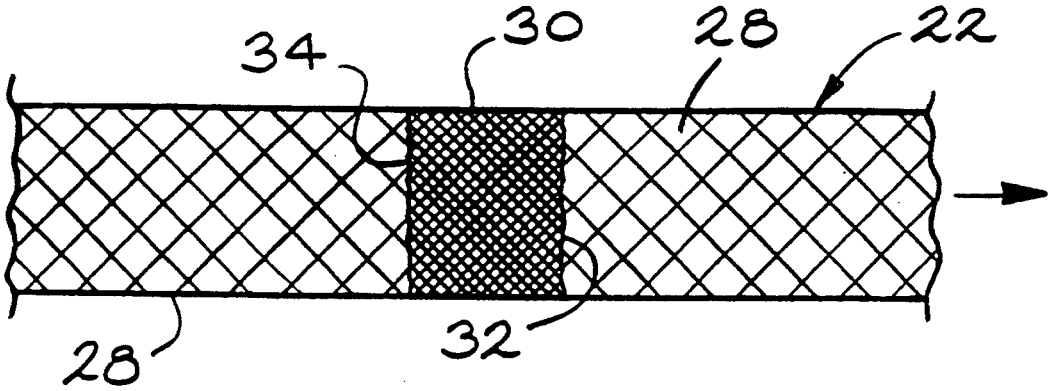
FIG. 2 is a schematic plan view of a typical prior art blend drop on a shingle machine moving at a slow speed.

As shown in FIG. 2, the typical prior art blend drop on a slow moving coated asphalt sheet will produce a granule coated asphalt sheet having background granules 28 and blend drop 30. With a slow moving coated asphalt sheet, blend drop 30 has a sharp leading edge 32 and sharp trailing edge 34.

Figure 3:
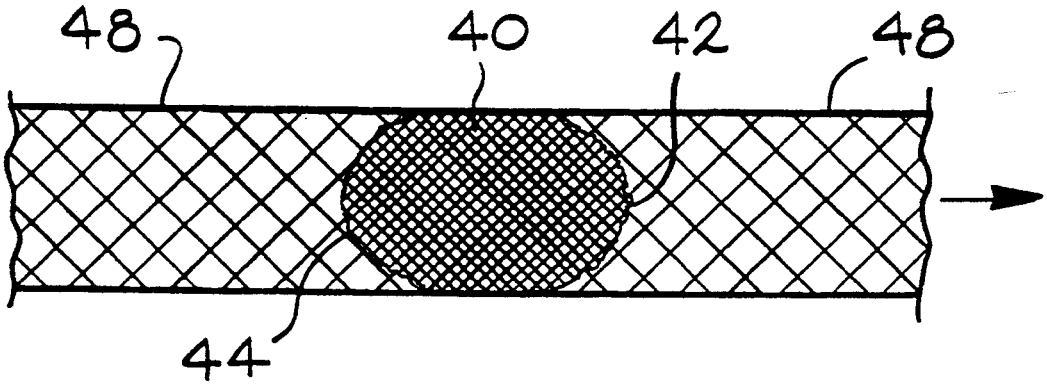
FIG. 3 is a schematic plan view of a typical prior art granule blend drop where the coated asphalt sheet is moving at a fast speed.

As shown in FIG. 3, when the coated asphalt sheet is speeded up, the blend drop 40 does not have sharp edges. The blend drop leading edge 42 and blend drop trailing edge 44 bulge or extend into background granules 48.

Figure 4:
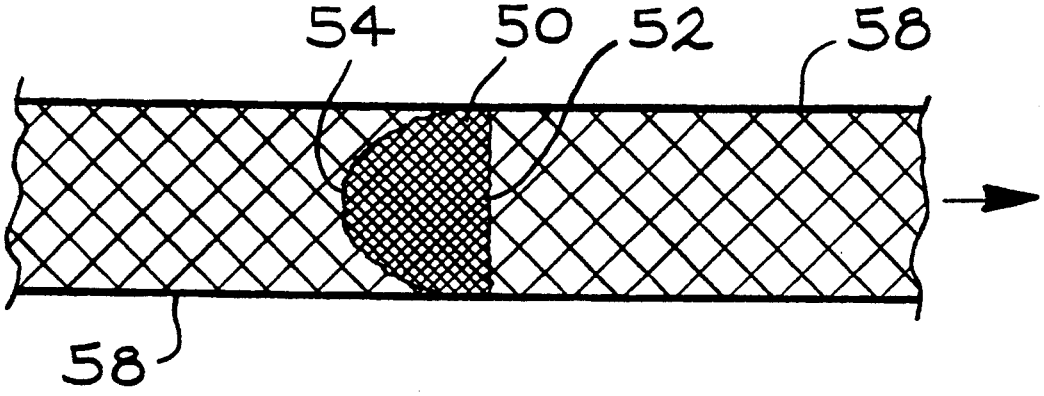
FIG. 4 is a schematic plan view of a granule blend drop having a sharp leading edge and a fuzzy trailing edge.

As shown in FIG. 4, an improved blend drop 50 produced with a pneumatically controlled granule applicator has sharp leading edge 52. However, the trailing edge 54 is still fuzzy, and extends into the background granules 58.

Figure 5:
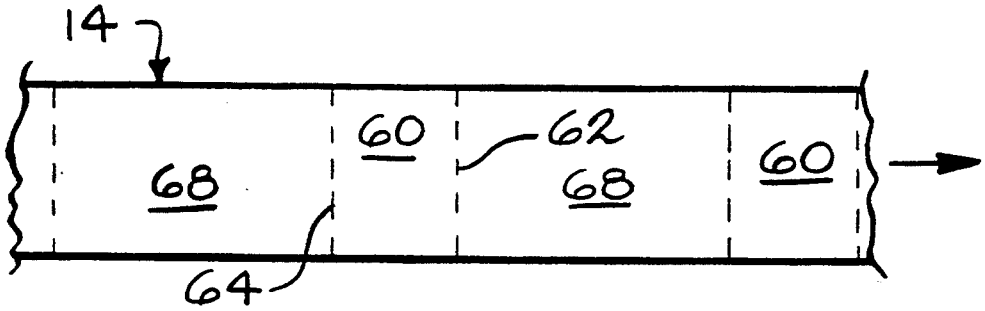
FIG. 5 is a schematic plan view of a portion of the coated asphalt sheet showing the predetermined blend drop areas according to the principles of the invention.

As shown in FIG. 5, the coated asphalt sheet can be viewed as having predetermined blend drop areas 60. These are the areas where the differentiated color of granules are to be applied. It should be understood that these areas can be granules for shadow lines, such as black granules, as well as any other differentiated color granules. The leading edges of the predetermined blend drop areas are shown as phantom lines 62 and the trailing edges are shown as phantom lines 64. The spaces between the predetermined blend drop areas are the background drop areas 68.

Figure 6:
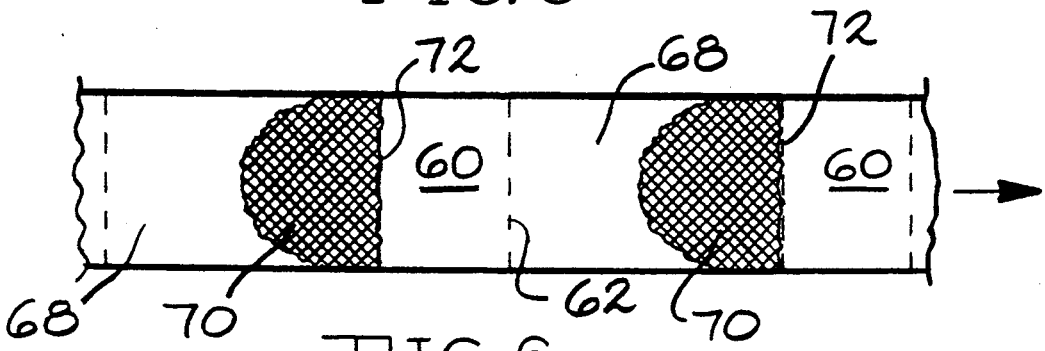
FIG. 6 is a schematic plan view of the coated asphalt sheet of FIG. 5 showing background drop granules applied to define the trailing edge of the blend drop areas.

As shown in FIG. 6 when the background drop 70 is applied, it has a sharp leading edge 72 which is coincident with trailing edge 64 of the blend drop area. It can be seen that the background drops are positioned immediately upstream from the predetermined blend drop areas so that the leading edge of each background drop defines the trailing edge of the blend drop areas.

Figure 7:
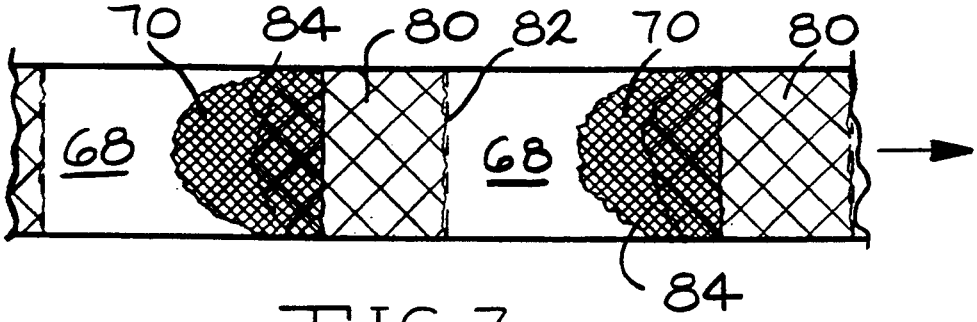
FIG. 7 is a schematic plan view of the coated asphalt sheet of FIG. 5 showing the blend drop granules applied to the predetermined blend drop areas.

As shown in FIG. 7, blend drops 80 are applied onto the blend drop areas. The blend drop leading edge 82 defines a sharp line. The blend drop trailing edge 84 is fuzzy, but overlaps the previously applied background drop having the sharp leading edge 72.

Figure 8:
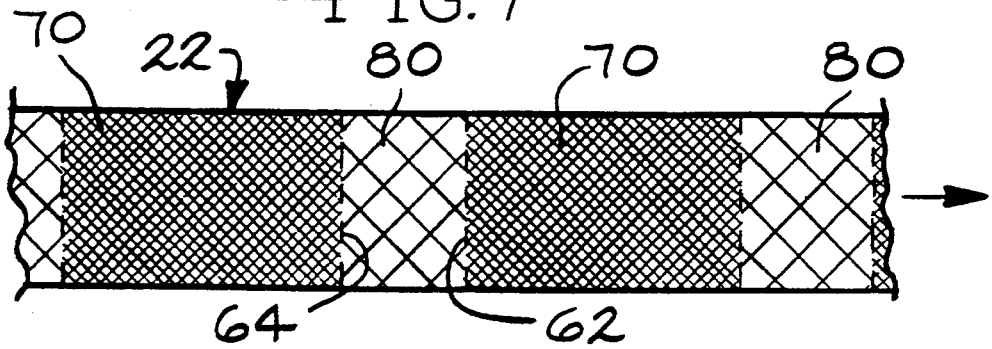
FIG. 8 is a schematic plan view showing the coated asphalt sheet of FIG. 7 having the remainder of background granules applied to the background areas, and the excess blend drop granules removed.

As shown in FIG. 8, when the remainder of the background granules is applied to complete the deposition of granules onto the asphalt-coated sheet, and the granule-covered asphalt sheet is turned over the slate drum to remove the excess blend drop granules, the blend drops will have sharp leading and trailing edges.

Referring again to FIG. 1, operation of the method of the invention involves first depositing background granules from hopper 16 to define the trailing edge of the blend drop areas. Then the blend drops are made from hopper 18. Finally, the remainder of the background granules are dispensed from hopper 20.

For purposes of this invention, a "sharp" edge means that substantially all (at least 90%, and, preferably, at least 95%) of the boundary between one color and another lies within about 0.4 inches (1.0 cm) of a straight line drawn along the boundary. For a typical shingle the boundary will be about 13 cm long. The term "fuzzy" means that the boundary is not sharply defined, and that the granules of one color overlap a substantial distance into the area of another color. Generally, a fuzzy edge is an edge that is not a sharp edge.

A preferred granule dispensing apparatus useful with the invention will now be described. A nozzle, not shown, holds an accumulation of granules. The exit or throat of the nozzle narrows down to a slot which is considerably smaller in cross-sectional area than the surface area of the accumulation of granules. A buffer chamber, not shown, is positioned above the surface of the accumulation of granules in the nozzle. Changes in the pressure of the buffer chamber which affect the flow of granules through the slot.

The application of negative gauge pressure to the buffer chamber will create a sufficient pressure drop over the accumulation of granules to stop the flow of granules through the slot. Likewise, the application of positive gauge pressure to the buffer chamber will cause a resumption of the flow of granules through the slot. The negative and positive gauge pressures in the buffer chamber can be created by opening and closing valves communicating with sources of negative and positive pressure air, such as air fans or air pumps, not shown.

When a negative pressure is applied to the vacuum chamber and through the vacuum opening to the buffer chamber, there is produced an upward flow of air through the slot and through the granules that have accumulated in the nozzle. The upward flow of air provides an upwardly oriented drag force on the granules in contrast to the downward pull of gravity on the granules. If the proper amount of negative pressure is applied to the buffer chamber, the drag force from the upward flow of air through the slot will balance the pull of gravity on the granules, and the granules will be held in place rather than continue falling down through the slot.

Fluidization can occur if upward air velocity at the surface of the accumulation of granules creates drag force sufficient to cause some of the granules to become airborne. Airborne granules can foul the air handling system.

In order to most completely close off the slot when the granules are supposed to be stopped, it is preferable to use thin stainless steel flaps to help stop the flow of granules through the slot.

It will be evident from the foregoing that various modifications can be made to this invention. Such modifications, however, are considered as being within the scope of the invention.

INDUSTRIAL APPLICABILITY

This invention will be found to be useful in the production of granule coated discreet roofing shingles suitable for use in residential and commercial roofing applications.

We claim:

1. The method for applying granules to a moving coated asphalt sheet, comprising selecting blend drop areas on the sheet, the remainder of the sheet comprising background areas, depositing background granule drops on portions of the background areas such that the background granule drops have generally sharp leading edges which define upstream edges of the blend drop areas, depositing blend drops on the blend drop areas such that the blend drops have generally sharp leading edges and having trailing edges, and then depositing background granule drops on remaining portions of the background areas.

2. The method of claim 1 in which the generally sharp leading edges of the background granule drops define the trailing edges of the blend drops.

3. The method for applying granules to a moving coated asphalt sheet, comprising selecting blend drop areas on the sheet, the remainder of the sheet comprising background areas, depositing background granule drops on portions of the background areas such that the background granule drops have generally sharp leading edges which define upstream edges of the blend drop areas, depositing blend drops on the blend drop areas such that the blend drops have generally sharp leading edges and generally fuzzy trailing edges, and then depositing background granule drops on remaining portions of the background areas.

4. The method of claim 3 in which the generally sharp leading edges of the background granule drops define the trailing edges of the blend drops.

5. The method for applying granules to a moving coated asphalt sheet, comprising selecting blend drop areas on the sheet, the remainder of the sheet comprising background areas, depositing background granule drops on portions of the background areas such that the background granule drops have generally sharp leading edges which define upstream edges of the blend drop areas and have generally fuzzy trailing edges, depositing blend drops on the blend drop areas such that the blend drops have generally sharp leading edges and generally fuzzy trailing edges, and then depositing background granule drops on remaining portions of the background areas.

6. The method of claim 5 in which the generally sharp leading edges of the background granule drops define the trailing edges of the blend drops.

7. The method for applying granules to a moving coated asphalt sheet, comprising selecting shadow areas on the sheet, the remainder of the sheet comprising background areas, depositing background granule drops on portions of the background areas such that the background granule drops have generally sharp leading edges which define upstream edges of shadow areas, depositing on the shadow areas granules for forming shadow lines such that the granules for forming shadow lines have generally sharp leading edges and have trailing edges, and then depositing background granule drops on remaining portions of the background areas.

8. The method of claim 7 in which the generally sharp leading edges of the background granule drops define the trailing edges of the granule for forming shadow lines.

9. The method for applying granules to a moving coated asphalt sheet, comprising selecting shadow areas on the sheet, the remainder of the sheet comprising background areas, depositing background granule drops on portions of the background areas such that the background granule drops have generally sharp leading edges which define upstream edges of shadow areas, depositing on the shadow areas granules for forming shadow lines such that the granules for forming shadow lines have generally sharp leading edges and generally fuzzy trailing edges, and then depositing background granule drops on remaining portions of the background areas.

10. The method of claim 9 in which the generally sharp leading edges of the background granule drops define the trailing edges of the granule for forming shadow lines.

11. The method for applying granules to a moving coated asphalt sheet, comprising selecting shadow areas on the sheet, the remainder of the sheet comprising background areas, depositing background granule drops on portions of the background areas such that the background granule drops have generally sharp leading edges which define upstream edges of shadow areas and have generally fuzzy trailing edges, depositing on the shadow areas granules for forming shadow lines such that the granules for forming shadow lines have generally sharp leading edges and generally fuzzy trailing edges, and then depositing background granule drops on remaining portions of the background areas.

12. The method of claim 11 in which the generally sharp leading edges of the background granule drops define the trailing edges of the granules for forming shadow lines.

* * * * *